US007559976B2

(12) United States Patent
Krigmont et al.

(10) Patent No.: US 7,559,976 B2
(45) Date of Patent: Jul. 14, 2009

(54) MULTI-STAGE COLLECTOR FOR MULTI-POLLUTANT CONTROL

(76) Inventors: Henry Krigmont, 3600 Marigold St., Seal Beach, CA (US) 90740; Yuri Akishev, Solnechnaya St. 8-72, Troitsk, Moscow Region (RU) 142190

( * ) Notice: Subject to any disclaimer, the term of this patent is extended or adjusted under 35 U.S.C. 154(b) by 0 days.

(21) Appl. No.: 11/977,119

(22) Filed: Oct. 23, 2007

(65) Prior Publication Data

US 2008/0092736 A1 Apr. 24, 2008

Related U.S. Application Data

(60) Provisional application No. 60/853,954, filed on Oct. 24, 2006.

(51) Int. Cl.
*B03C 3/013* (2006.01)

(52) U.S. Cl. ..... 95/58; 55/DIG. 38; 95/78; 96/52; 96/60; 96/62; 96/73; 96/74; 96/75

(58) Field of Classification Search ..... 95/58, 95/78; 96/16, 52, 60, 62, 73–75, 95, 98; 55/DIG. 38
See application file for complete search history.

(56) References Cited

U.S. PATENT DOCUMENTS

| | | | | |
|---|---|---|---|---|
| 1,345,790 A | | 7/1920 | Lodge | 96/62 |
| 1,356,462 A | | 10/1920 | Nesbit | 96/87 |
| 1,605,648 A | | 11/1926 | Cooke | 95/79 |
| 2,654,438 A | | 10/1953 | Wintermute | 96/62 |
| 3,248,857 A | | 5/1966 | Weindel et al. | 96/49 |
| 3,440,800 A | | 4/1969 | Messen-Jaschin | 96/52 |
| 3,785,125 A | | 1/1974 | DeSeversky | 96/45 |
| 3,803,808 A | * | 4/1974 | Shibuya et al. | 96/54 |
| 3,818,678 A | | 6/1974 | Gothard | 95/75 |
| 3,839,185 A | | 10/1974 | Vicard | 204/665 |
| 3,915,676 A | | 10/1975 | Reed et al. | 55/432 X |
| 4,124,359 A | | 11/1978 | Geller | 55/130 |
| 4,147,522 A | | 4/1979 | Gonas et al. | 55/467 X |
| 4,203,948 A | * | 5/1980 | Brundbjerg | 422/121 |

(Continued)

FOREIGN PATENT DOCUMENTS

| | | | |
|---|---|---|---|
| GB | 2016305 A | 9/1979 | 96/96 |

(Continued)

OTHER PUBLICATIONS

U.S. Appl. No. 12/002,505, filed Dec. 17, 2007.

(Continued)

*Primary Examiner*—Richard L Chiesa
(74) *Attorney, Agent, or Firm*—Clifford Kraft

(57) ABSTRACT

A multi-stage collector for multi-pollutant control that contains alternating narrow and wide sections with glow discharge electrodes in some narrow sections, a uniform electric field in wide sections for collecting particles charged by the glow discharge and streamer discharge electrodes in wide or narrow sections that convert and destroy harmful gaseous pollutants such as $SO_2$, $NO_x$ and volatile organic compounds as well as convert heavy metals such as mercury into a particulate form. Steady state streamer discharge is supported by non-pulsed power supply. The streaming discharge can convert the polluting gases into nitric and sulfuric acid which can be removed by combining it with ammonia to form solid salts.

20 Claims, 5 Drawing Sheets

U.S. PATENT DOCUMENTS 4,354,858 A 10/1982 Kumar et al. ..... 55/DIG. 5
4,357,151 A 11/1982 Helfritch et al. ..... 55/302 X
4,375,364 A 3/1983 Van Hoesen et al. ..... 96/87
4,411,674 A 10/1983 Forgac ..... 55/304
4,505,795 A 3/1985 Alamaro ..... 204/179
4,657,738 A 4/1987 Kanter et al. ..... 422/186.04
4,695,358 A 9/1987 Mizuno et al. ..... 204/174
4,874,586 A 10/1989 Szymanski et al. ..... 55/380 X
4,904,283 A 2/1990 Hovis et al. ..... 96/66
5,024,681 A 6/1991 Chang ..... 95/70
5,024,685 A 6/1991 Torok et al. ..... 96/43
5,066,313 A 11/1991 Mallory, Sr. ..... 95/57
5,154,733 A * 10/1992 Fujii et al. ..... 95/57
5,158,580 A 10/1992 Chang ..... 95/70
5,173,098 A 12/1992 Pipkorn ..... 55/379
5,185,015 A 2/1993 Searle ..... 96/16
5,217,511 A 6/1993 Plaks et al. ..... 55/334 X
5,433,772 A * 7/1995 Sikora ..... 96/187
5,527,569 A 6/1996 Hobson et al. ..... 55/382 X
5,531,798 A 7/1996 Engstrom et al. ..... 248/77
5,547,493 A 8/1996 Krigmont ..... 96/154
5,547,496 A 8/1996 Hara ..... 96/79
5,582,632 A * 12/1996 Nohr et al. ..... 95/78
5,601,791 A 2/1997 Plaks et al. ..... 422/169
5,695,549 A 12/1997 Feldman et al. ..... 96/55
5,733,360 A 3/1998 Feldman et al. ..... 95/78
5,938,818 A 8/1999 Miller ..... 95/63
5,944,857 A 8/1999 Edwards et al. ..... 29/25.01
6,152,988 A 11/2000 Plaks et al. ..... 95/58
6,193,782 B1 2/2001 Ray ..... 95/4
6,221,136 B1 4/2001 Liu et al. ..... 96/66
6,245,299 B1 6/2001 Shiloh et al. ..... 422/121
6,247,301 B1 6/2001 Brännström et al. ..... 60/39.12
6,294,003 B1 * 9/2001 Ray ..... 96/49
6,340,379 B1 1/2002 Penth et al. ..... 95/45
6,429,165 B1 8/2002 Nastke et al. ..... 55/524 X
6,482,371 B1 11/2002 Rasmussen ..... 423/1
6,482,373 B1 11/2002 Hannaford et al. ..... 423/47
6,514,315 B1 2/2003 Chang ..... 95/70
6,517,786 B1 2/2003 Best et al. ..... 422/186.04
6,524,369 B1 2/2003 Krigmont ..... 95/78
6,527,834 B1 3/2003 Jörder et al. ..... 55/524 X
6,544,317 B2 * 4/2003 Miller ..... 95/63
6,585,809 B1 * 7/2003 Parsa ..... 96/16
6,623,544 B1 * 9/2003 Kaura ..... 95/13
6,660,061 B2 * 12/2003 Josephson et al. ..... 95/2
6,869,467 B2 * 3/2005 Scheuch ..... 96/55
6,926,758 B2 * 8/2005 Truce ..... 95/78
6,932,857 B1 8/2005 Krigmont ..... 95/63
7,105,041 B2 * 9/2006 Dunn ..... 96/66
7,112,236 B2 * 9/2006 Hoverson et al. ..... 95/78
7,264,658 B1 * 9/2007 Heckel et al. ..... 96/62
7,267,712 B2 9/2007 Chang et al. ..... 96/177
7,270,692 B2 * 9/2007 Gillingham et al. ..... 55/486
7,300,499 B1 * 11/2007 Fleisher ..... 96/16
7,332,020 B2 * 2/2008 Tanaka et al. ..... 96/66
2003/0177901 A1 * 9/2003 Krigmont ..... 95/78
2004/0025690 A1 * 2/2004 Krigmont ..... 95/78
2006/0254423 A1 * 11/2006 Tanaka et al. ..... 96/66
2006/0278082 A1 * 12/2006 Tomimatsu et al. ..... 96/66
2007/0068387 A1 * 3/2007 Pletcher et al. ..... 96/83
2007/0157814 A1 * 7/2007 Kim et al. ..... 96/61
2007/0283810 A1 * 12/2007 Besi ..... 96/64

FOREIGN PATENT DOCUMENTS

JP 5-96125 A * 4/1993 ..... 96/16

OTHER PUBLICATIONS

U.S. Appl. No. 12/009,374, filed Jan. 19, 2008.

* cited by examiner

MULTI-STAGE COLLECTOR FOR MULTI-POLLUTANT CONTROL

This application is related to and claims priority from U.S. Provisional Patent application No. 60/853,954 filed Oct. 24, 2006. Application 60/853,954 is hereby incorporated by reference.

BACKGROUND

1. Field of the Invention

The present invention relates generally to pollutant removal from industrial gas outputs and more particularly to a multi-stage collector for multi-pollutant control.

2. Description of the Prior Art

Ever increasing energy consumption is a fact of life. Unfortunately, the energy producing industry is inevitably associated with emissions of vast amounts of dust, heavy metals such as mercury and various harmful gaseous contaminants such as sulfur dioxide and oxides of nitrogen. These two gases are major anthropogenic acid gases that lead to the formation of acid precipitation and photochemical smog and have an adverse effect on human health and on vegetation.

Traditionally, individual removal of either sulfur oxides ($SO_2$) or nitrous oxides ($NO_x$) can be achieved by independent air pollution control devices. For large scale emitters, Flue Gas Desulphurization (FGD) is the state of the art control technology for $SO_2$ removal, while Selective Catalytic Reduction (SCR) and Selective Non-Catalytic Reduction (SNCR) serve as technologies for $NO_x$ removal. Unfortunately, $SO_2$ and $NO_x$ coexist in flue gases in many cases, such as the combustion of heavy oil, diesel fuel and coal. The need for separate removal of pollutants is a major weakness of current methods. It would be extremely advantageous and cost-effective to have an efficient technology for simultaneous removal of multiple pollutants like $SO_2$, $NO_x$ and heavy metals like Hg. Such a simultaneous technology would result in a great reduction of capital expenditure and a great reduction in space needed by power plants.

Non-thermal plasma at atmospheric pressure can be used effectively as part of such simultaneous technology. Many types of non-thermal plasma reactors for processing of exhausted gases have been developed. At the heart of these devices is generally a plasma source that generates many chemically active species such as (O, OH, $HO_2$ etc.) in treated gases at atmospheric pressure without essentially heating the gases. Dielectric barrier discharge (DBD), and pulsed corona discharge (PCD), are well known as such plasma sources. However these types of discharges have intrinsic limitations associated with necessity to use narrow inter-electrode gaps and short high voltage pulses for the DBD and PCD respectively that results in difficulties in introducing these sources into real practice.

Krigmont in U.S. Pat. Nos. 6,524,369, and 6,932,857 teaches several new concepts for simultaneous particulate and gas removal from effluent gases through the use of steady-state corona discharge, electrostatic precipitation and barrier filtration. The present invention is an extension of the principles taught in these patents. Applications Ser. Nos. 6,524,369 and 6,932,857 are hereby incorporated by reference. This technology can be successfully used for controlling volatile organic compounds as well (instead of the normal approaches based on thermal incineration, catalytic oxidation and carbon absorption).

SUMMARY OF THE INVENTION

The present invention relates to advanced technology for the simultaneous removal of multiple pollutants from flue gas. The present invention relates to the simultaneous use of 1) steady-state diffusive glow discharge, 2) steady-state positive streamer corona along with the use conventional particulate collection techniques to optimize the efficiency of a precipitator. A new form of atmospheric pressure gas discharge called steady state glow discharge can dramatically increase the average electric field strength in a precipitator which in turn can increase the efficiency of the precipitator. Steady-state positive streamer corona can generate effectively chemical active species in the effluent gases. This can increase the removal efficiency of hazard pollutants. The present invention allows the use of a single DC or AC power supply to provide the different types of discharge and to provide linear electric field collection.

An embodiment of the invention includes a multi-stage collector for multi-pollutant control that has a plurality of wide and narrow alternating sections where the narrow sections in general exceed markedly really narrow gaps of normal DBD; a glow discharge electrode in a first narrow section; a wide section containing an approximately uniform electric field and at least one surface for collecting charged dust particles; a streamer discharge electrode in a second narrow section; where particles become charged in the first narrow section and collected in the wide section, and where gaseous pollutants are destroyed in the second narrow section. The collector can use a single power supply for the first narrow section, the wide section and the second narrow section.

DESCRIPTION OF THE FIGURES

Attention is directed to several figures that illustrate embodiments of the present invention.

Figure 1:
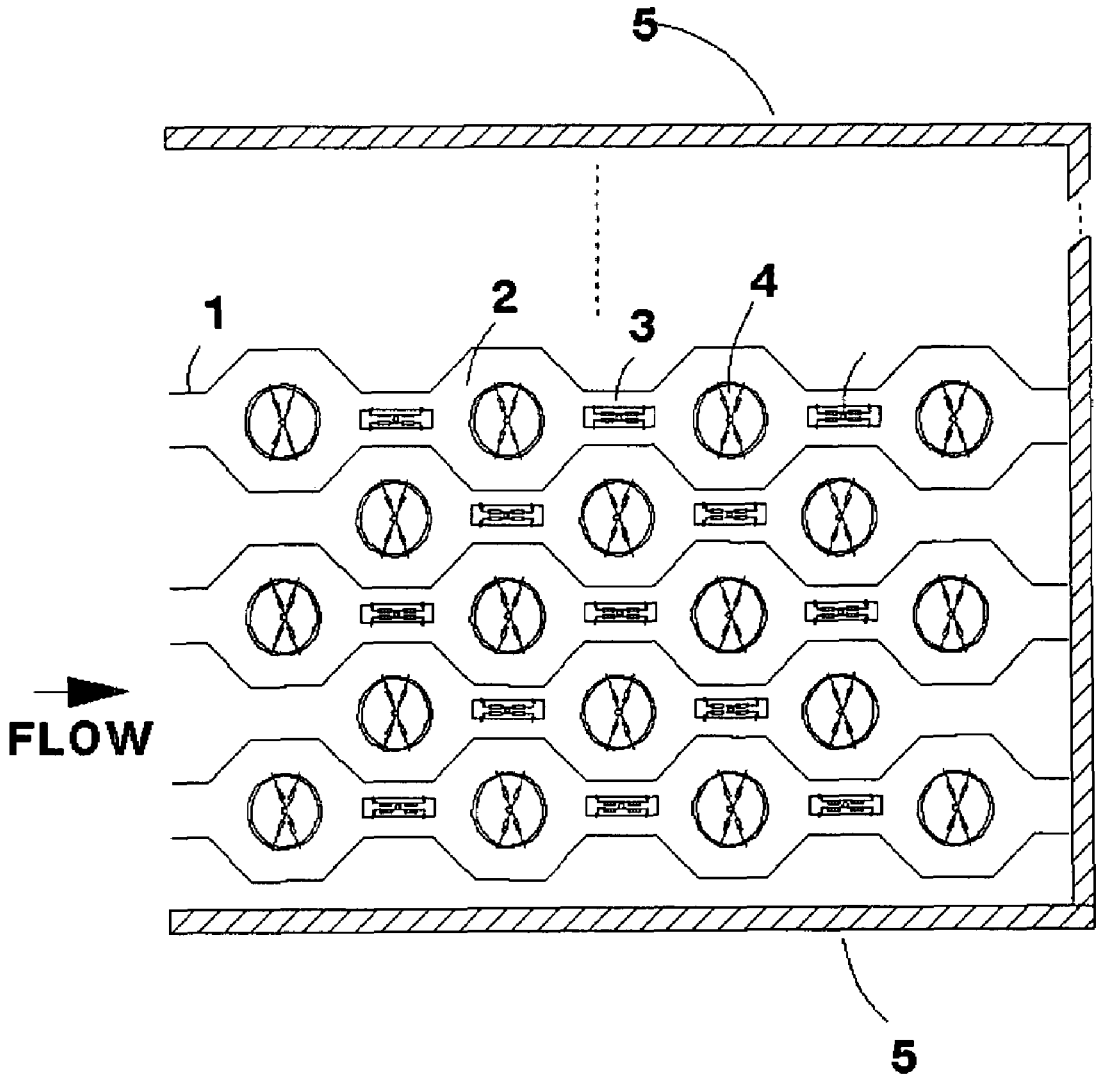
FIG. 1 shows a cross-section of an embodiment of the present invention.

Several illustrations and drawings have been presented to aid in understanding the present invention. The scope of the present invention is not limited to what is shown in the figures.

DESCRIPTION OF THE INVENTION

The present invention makes use of non-thermal plasmas (NTP) to destroy harmful gaseous components. An NTP can be created by different gas discharges (DC, AC or pulsed) at atmospheric pressure. Prior art methods of creating an NTP are dielectric barrier discharge (DBD) and pulsed corona discharge (PCD). DBD and PCD have intrinsic limitations associated with necessity to use very narrow inter-electrode gaps and very short high voltage pulses (for DBD and PCD respectively) that results in difficulties under introducing these sources into real practice. An NTP in flue gas is a quasi-neutral mixture of charged particles (electrons, positive and negative ions), chemical active particles like radicals and photons. Photons are created due to collisions of energetic electrons with molecules of the background gas. A very useful property of an NTP is that the majority of the electric energy deposited in the treated gas goes into heating the electrons rather than heating the gas. The typical average electron energy (or electron temperature) in an NTP is around 30,000 to 50,000 degrees K (around 3-4 eV), but the average temperature of the background gas is around 300-500 degrees K. In the case of a gas flow containing $N_2$, $O_2$ and $H_2O$, most of the primary radicals generated in an NTP are O and OH. These radicals are generated due to plasma reactions initiated by energetic electrons and excited species like molecular nitrogen $N^*_2$ and atomic oxygen $O(^1D)$ as following:

$$e+O_2 \rightarrow O+O+e$$

$$e+O_2 \rightarrow O+O(^1D)+e$$

$$O(^1D)+H_2O \rightarrow OH+OH$$

$$e+H_2O \rightarrow OH+OH+e$$

$$e+N_2 \rightarrow N_2^*+e$$

$$N_2^* = N_2(A^3\Sigma, B^3\pi, C^3\pi, \ldots)$$

$$N_2^*+O_2 \rightarrow N_2+O+O$$

$$N_2^*+O_2 \rightarrow N_2+O+O(^1D)$$

O and OH radicals rapidly oxidize NO and $SO_2$ to form $NO_2$ and $SO_3$ which become nitric and sulfuric acids as well as forming the acids directly. The gaseous acids can be transformed into salts with gaseous ammonia. The salts can be removed as solids. For example, $$NO+OH+M \rightarrow HNO_2+M \text{(where M is a third particle).}$$

m can be an $N_2$ molecule for example (where the rate coefficient is k=6.7×10(−31) cm^6/s. Nitrous acid $HNO_2$ is further converted:

$$HNO_2+OH \rightarrow NO_2+H_2O.$$

In the case of O radicals, the formation of $NO_2$ takes place in a single step:

$$NO+O+M \rightarrow NO_2+M.$$

Nitrogen dioxide $NO_2$ forms nitric acid upon reacting with OH:

$$NO_2+OH+N_2 \rightarrow HNO_3+N_2(k=2.6\times10(-30))$$

A set of similar reactions convert $SO_2$:

$$SO_2+OH \rightarrow HSO_3+O_2 \rightarrow SO_3.$$

Sulfur trioxide $SO_3$ is converted by water to sulfuric acid. Gaseous nitric and sulfuric acid is converted by ammonia to ammonium nitrate and ammonium sulfate respectively. Both of these are solid salts that can be collected and removed. The present invention can simultaneously treat SOx and NOx pollutants. In this case, there is an interplay for intermediate species of these pollutants that results in a positive synergy effect in the destruction of both of them. It should also be noted that a non-thermal plasma promotes the formation of $H_2SO_4$ molecules in a gas flow polluted with SOx. It is possible to increase the concentration of these molecules more than the threshold for condensation of gaseous sulfuric acid into small droplets of liquid acid. Precipitation of these conductive droplets onto a layer of high resistive particles collected by a collector electrode can result in diminishing the surface charge on the dust layer and therefore preventing a back-corona effect. This leads to an increase in the effectiveness of precipitation of high resistive particles.

Control of heavy metals is also important. Joint gas phase reactions of radicals and ammonia with gaseous mercury provided by an NTP can effectively transform 80-90% of the Hg into fine particles that can be collected by precipitators or fabric filters.

The molecular temperature of flue gases at the inlet to a cleanup device is about 150 degrees C. In an NTP system, the increase in temperature of the gas at the outlet due to glow discharge or corona discharge does not exceed several tens of degrees. This slight temperature increase is entirely acceptable because it is not enough to induce generation of harmful molecules like $NO_x$ and $SO_2$ in the effluent gas stream. It is well known in the art that reactions that produce such products from $N_2$ and $O_2$ require from 1,000-2,000 degrees C. The NTP system of the present invention also does not produce much ozone. This is because the humidity of flue gases is around 10% by volume (relatively high). With a temperature of around 150 degrees C., the temperature/humidity combination result in a strong suppression of ozone generation from O atoms.

Figure 2:
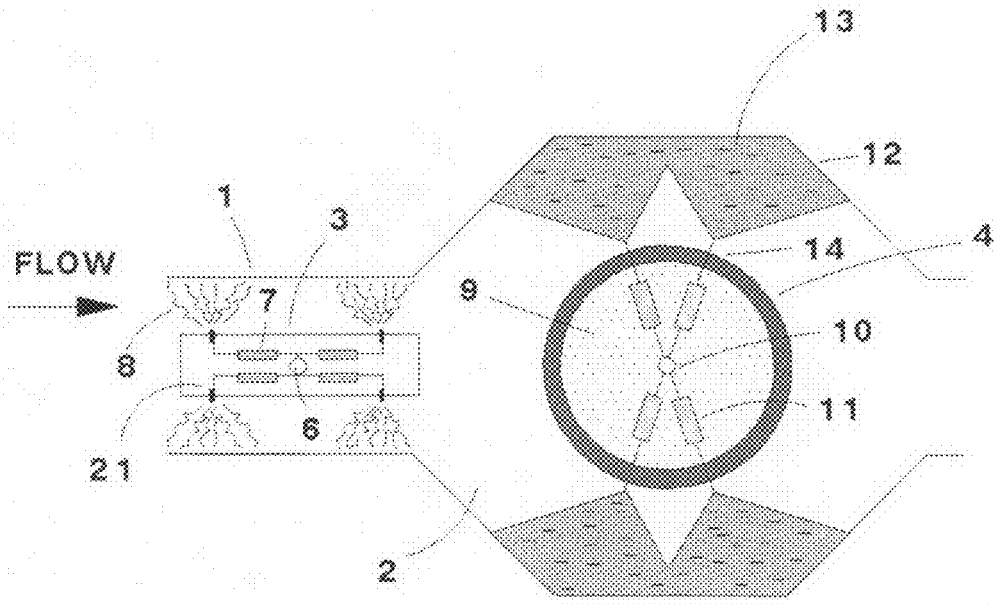
FIG. 2 shows an enlargement of one element in the embodiment of FIG. 1

Turning to FIGS. 1-2, an embodiment of the NTP system of the present invention is shown. FIG. 1 shows a cross-section of a precipitator, while FIG. 2 shows a single narrow-wide region. Generally, narrow and wide regions alternate. In a first narrow region of the precipitator 1, a high tension, low current glow discharge realized with the use of individually ballasted electrodes 21 which interact with the gas stream. This glow discharge replaces the negative corona discharge of a conventional precipitator. Due to the special shape of the electrodes, glow discharge is stable with respect to addition in treated gas of water vapor, small admixtures like $NH_3$ and dust and therefore can drastically increase the efficiency of charging dust particles. A region of linear electric field in a subsequent wide section 2 allows collection of the charged dust particles. Further into a wide section, a high tension, high current steady state positive streamer discharge realized with use of special shape and individually ballasted electrode 14 causes a generation of chemically active species providing the conversion and destruction of harmful pollutants. It should be understood that the sequence of glow discharge and streamer corona in narrow and wide sections can be varied to maximize the efficiency of the device. Any disposition of glow discharge and streamer corona is within the scope of the present invention.

The initial glow discharge increases the electric field strength in those states of the system that are devoted to dust collection, and the steady-state positive streamer corona is used in those stages dedicated to destruction of pollutants. The geometric shape of the regions is generally similar to the shapes shown in FIG. 2, which is a blowup of one of the areas from FIG. 1. The narrower regions are used to generate corona, while the wider regions contain a uniform electric field and are used for particle collection. Collectors and filters can be made with conductive surfaces. The present invention works particularly well with high resistivity ash such as the high calcium ash that results from the burning of Powder River Basin coal. Such high resistivity ash is very difficult to collect using prior art techniques.

The operation of a typical embodiment of the present invention operates as follows: Ash laden flue gas enters the system from a combustion section that is normally fossil fuel-fired with water cooled inserts to control the gas temperature leaving the burner section. The effluent gas containing particles passes through an alternating series of glow discharge regions 8, constant field collection regions 2 and streamer discharge regions 13 in narrow 1 and wide 12 areas. Electrodes 16 protruding from a glow-discharge module 3 cause the discharge. A non-pulsed power source supplies steady state current through an entry conductor 6 and through individual ballast resistors 7 to produce the glow discharge regions 8 from the electrodes 21. Similarly, the streamer discharges are produced from current entering through an entry conductor 10 inside a barrier filter 4 (with interior 9). The higher current flows through the individual ballast resistors 11 to electrodes 14 that create steady state streamer corona regions 13.

Numerous streamers of steady state corona starting from the electrode 14 time after time with high frequency travel chaotically across the streamer section 13. Due to this, energetic electrons are created abundantly and constantly in whole volume of the treated gas that results in transfer of energy to the dominate gas molecules ($N_2$, $O_2$, $H_2O$, $CO_2$) by collisions. This results in the formation of primary radicals (O, N, OH), positive and negative ions and excited molecules. Later the electron-ion, ion-ion, radical-radical reactions like $O+OH \rightarrow HO_2$, and electron detachments create more secondary radicals ($HO_2$, etc.). Large amounts of O, $O_2$, OH, and H radicals are easily generated in the coronas. The radicals either oxidize $SO_2$ and $NO_x$ or react with them to form aerosols. Since the formation energy of the radicals is approximately 10 eV, the energy of the corona discharge is sufficient to produce the radicals. The result is that gaseous nitric and sulfuric acid is produced. Ammonia can be introduced into the effluent stream at a point downstream from the streamer discharge that is acid-rich. The ammonia salts can be collected with filters or the like in cooler sections. The ammonia can be injected as a gas or in the form of urea or other amine. Barriers 4 and filters (not shown) in the apparatus of the present invention can be cleaned in standard ways such as polarity reversal and rapping.

Figure 3:
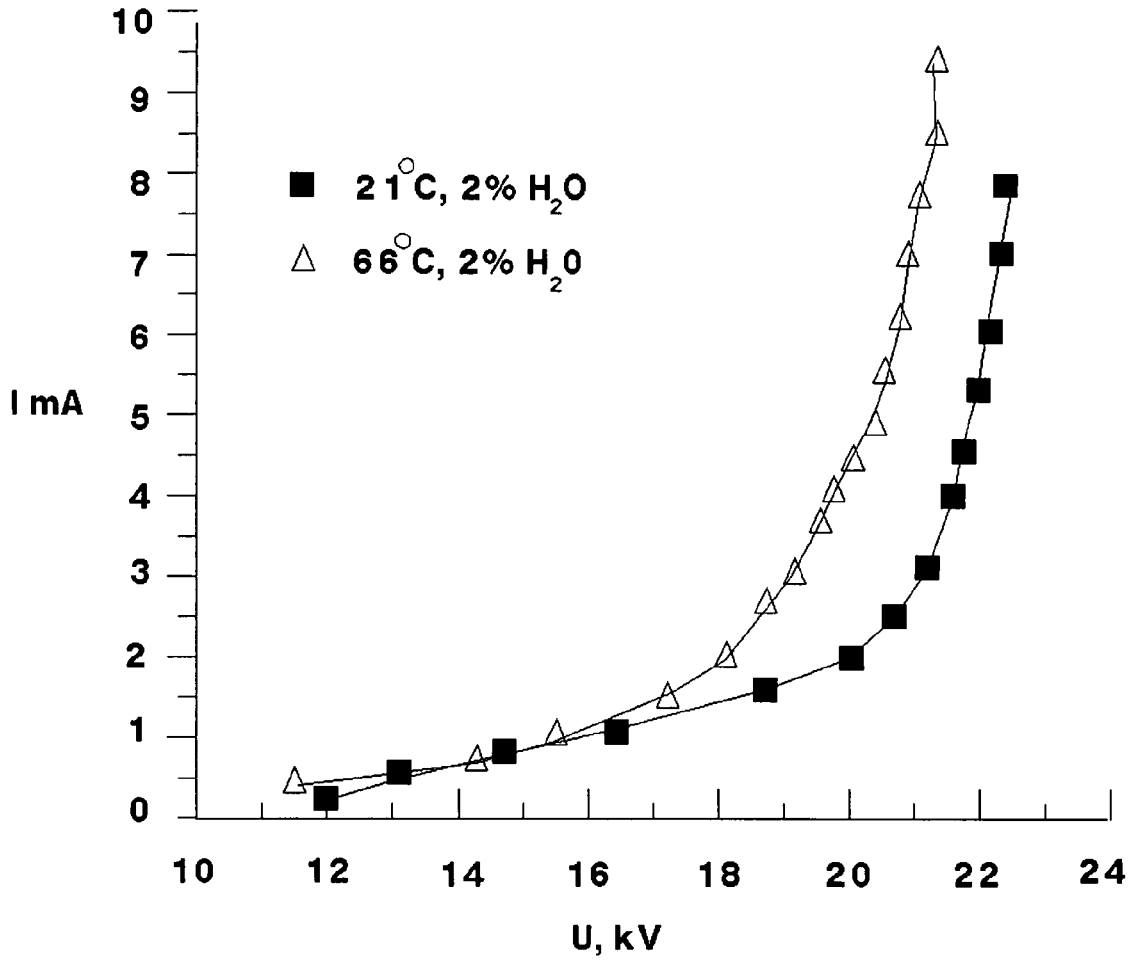
FIG. 3 shows a typical I-V curve.
Figure 4:
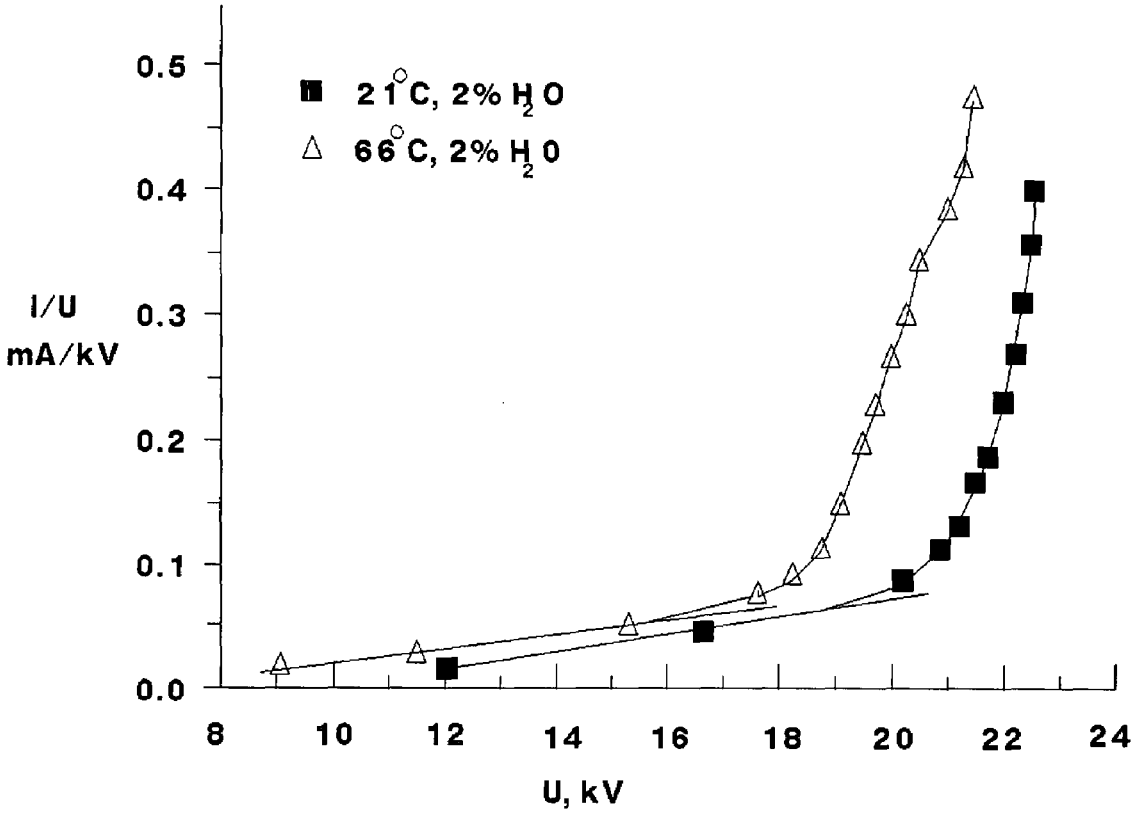
FIG. 4 shows a curve of I/V vs V curve.

FIG. 3 shows a current vs. voltage graph for a streamer corona discharge system that displays voltage in kV on the horizontal axis and current in mA on the vertical axis. Plots at two different temperatures are shown, 21 degrees C. and 66 degrees C. All of the data was taken at 2% $H_2O$. FIG. 4 shows the reduced discharge currents I/U vs. applied voltages U. The linear portions of the curves at low currents correspond to normal corona discharges. Non-linear portions of the curves with dramatically increasing currents correspond to novel regimes of high-current steady state streamer corona realized in this invention due to the special shape of the electrodes and using of individual ballast resistors. A preferred operating point in the system measured would be around 20-22 kV. The graphs of FIGS. 3-4 are merely an example of operation of the present invention. The exact corona region and current vs. voltage curves depend on many variables including geometry, humidity, temperature and gas content and can be optimized for each specific conditions.

Figure 5:
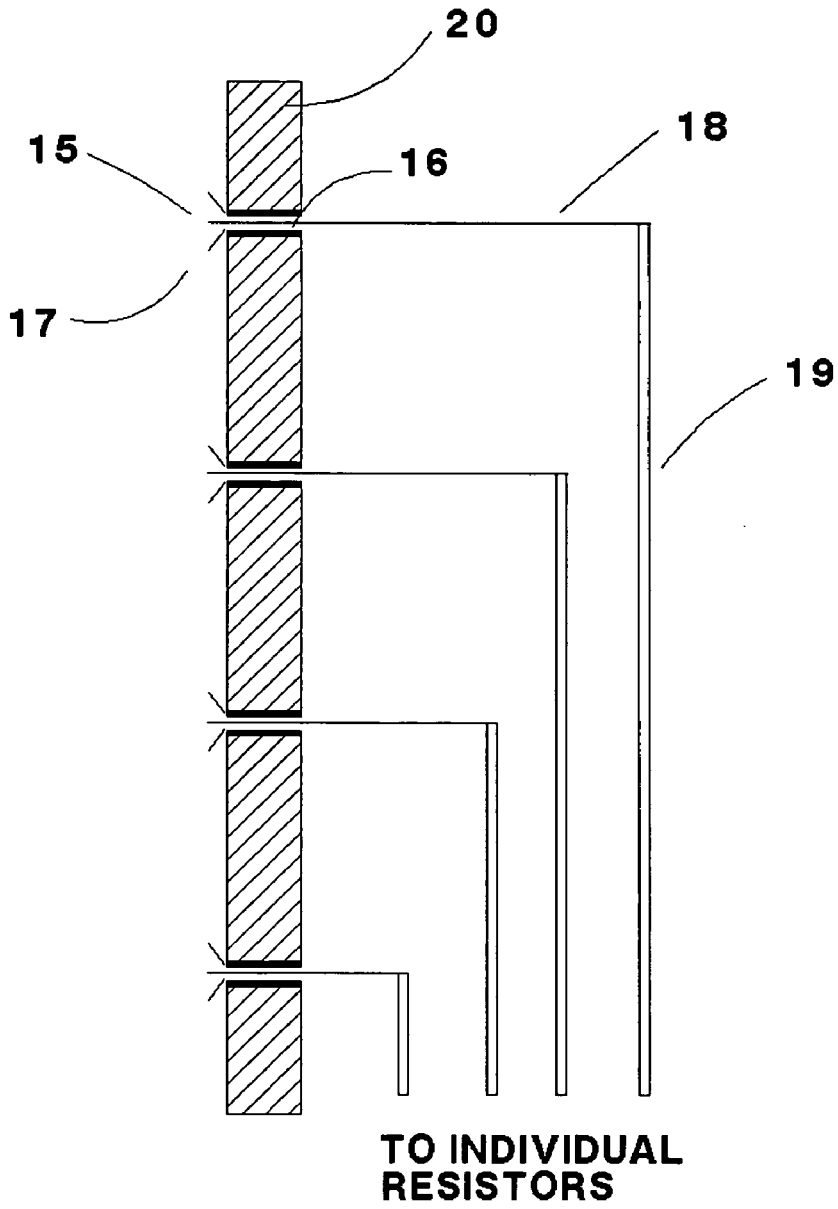
FIG. 5 shows a way of mounting electrodes.

FIG. 5 shows a way of mounting electrodes on a substrate 20. An inner pointed electrode 15 protrudes through a hole 16 in the surface. This pointed electrode 15 can be a copper rod. A flared section of copper tube 17 runs through the hole 16. The flare angle can be around 60 degrees; however, many other angles will work. A bare section 18 of the electrode 15 can run away from the inner surface of the cylinder. At some point under the surface, the electrode can turn and enter a jacket of TEFLON (TM) or other high voltage insulation 19. A group of these insulated electrode feeders can run to individual ballast resistors as discussed and shown in other figures. it should be noted that while copper has been specified as a preferred electrode metal, any other conductor or metal can be used and is within the scope of the present invention.

Several descriptions and illustrations have been provided to aid in the understanding of the present invention. One skilled in the art will realize that numerous changes and variations are possible without departing from the spirit of the invention. Each of these changes and variations is within the scope of the present invention.

We claim:

1. A method for multi-pollutant control of gaseous and particle pollutants in mixture of gases comprising the steps of:

passing said mixture of gas through an alternating series of glow discharge regions, constant field collection regions, and corona streamer discharge regions in narrow and wide areas defined by spaced electrodes;

causing steady state dissipation in said regions of non-pulsed electrical power of sufficiently high voltage to establish therein a continuous glow discharge and a streamer corona discharge, whereby $SO_2$ and/or $NO_x$ and/or heavy metals are converted to acid mist and/or particle aerosols;

collecting said acid mist and/or particle aerosols.

2. The method of claim of 1 wherein said mixture of gases contains air.

3. The method of claim of 1 wherein said mixture of gases is a stack gas.

4. The method of claim of 1 wherein said mixture of gases is effluent from an industrial process.

5. The method of claim of 1 wherein said mixture of gases is exhaust from an internal combustion engine.

6. The method of claim of 1 wherein said mixture of gases contains volatile organic compounds.

7. The method of claim 1 wherein said narrow regions contain glow discharge electrodes.

8. The method of claim 1 wherein said wide regions contain constant field regions and corona streamer discharge regions.

9. The method of claim 1 wherein said corona streamer discharge regions contain corona streamer electrodes.

10. The method of claim 1 wherein ammonia is introduced into said mixture of gases.

11. An apparatus for removing pollutants from a flow stream comprising alternating narrow and wide regions, said narrow regions containing first electrodes driven by a first voltage to produce a glow discharge, said wide regions biased to create a relatively constant electric field between an outer boundary and an inner boundary, said wide regions also containing second electrodes driven by a second voltage to produce a corona streamer discharge between said second electrodes and said outer boundary.

12. The apparatus of claim 11 wherein said first and second electrodes are electrically connected to ballast resistors.

13. The apparatus of claim 11 wherein said inner boundary is a barrier filter.

14. The apparatus of claim 11 wherein ammonia is introduced into said flow stream upstream of said narrow and wide regions.

15. The apparatus of claim 11 wherein said first and second voltage is AC.

16. An apparatus for removing pollutants from a flow stream comprising a plurality of narrow and wide regions formed intro rows from boundaries laterally offset such that portions of a boundary that forms a wide region on one row forms a narrow region on a next row, said narrow regions including first electrodes driven by a first voltage to produce a glow discharge, said wide regions biased to create a relatively constant electric field between an outer boundary and an inner boundary, said wide regions including second electrodes driven by a second voltage to produce a corona streamer discharge between said second electrodes and said outer boundary.

17. The apparatus of claim 16 wherein said first and second electrodes are electrically connected to ballast resistors.

18. The apparatus of claim 16 wherein said inner boundary is a barrier filter.

19. The apparatus of claim 16 wherein ammonia is introduced into said flow stream upstream of said narrow and wide regions.

20. The apparatus of claim 16 wherein said first and second voltage is AC.

* * * * *